US005727044A

United States Patent [19]

Fraser et al.

[11] Patent Number: 5,727,044

[45] Date of Patent: Mar. 10, 1998

[54] MICROCHANNEL PLATES

[75] Inventors: George William Fraser; Adam North Brunton, both of Leicester; Adam Medley, Suffolk; Carl Jonathan Metcalf, Staffordshire, all of Great Britain

[73] Assignee: University of Leicester, Leicester, United Kingdom

[21] Appl. No.: 776,167

[22] PCT Filed: Jul. 19, 1994

[86] PCT No.: PCT/GB95/01711

§ 371 Date: Apr. 17, 1997

§ 102(e) Date: Apr. 17, 1997

[87] PCT Pub. No.: WO96/02919

PCT Pub. Date: Feb. 1, 1996

[30] Foreign Application Priority Data

Jul. 19, 1994 [GB] United Kingdom ..... 9414518

[51] Int. Cl.[6] ..... G21K 1/02

[52] U.S. Cl. ..... 378/149; 250/505.1; 378/84

[58] Field of Search ..... 250/505.1, 363.1; 378/84, 85, 149, 154, 147

[56] References Cited

U.S. PATENT DOCUMENTS 4,748,328 5/1988 Chang et al. .

5,479,469 12/1995 Fraser et al. ..... 378/149

FOREIGN PATENT DOCUMENTS 626 700 11/1994 European Pat. Off. .

2 002 575 2/1979 United Kingdom .

OTHER PUBLICATIONS

Fraser et al: "Production of quasi-parallel X-ray beams using microchannel plate X-ray lenses", Nuclear Instruments And Methods In Physics Research -vol. 334, No. 2-3. (1993) pp. 579-588.

Database WPI, Sec. PQ, Week 7851, Derwent Publications Ltd., London Class P61, An 78-L1281A & SU.A.505 558-May 15, 1978, see abstract.

Wilkins et al: "On the concentration, focusing, and collimation of x-rays and neutrons using microchannel plates and configurations of holes", Review of Scientific Instruments, vol. 60, No. 6, Jun. 1989, pp. 1026-1036, XP000035867.

*Primary Examiner*—David P. Porta

*Attorney, Agent, or Firm*—Cushman Darby & Cushman IP Group Pillsbury Madison & Sutro LLP

[57] ABSTRACT

A tapered, spherically slumped, microchannel plate.

4 Claims, 10 Drawing Sheets

MICROCHANNEL PLATES

This application is the national phase of international application PCT/GB95/01711, filed Jul. 19, 1995 which designated the U.S.

This invention relates to microchannel plates (MCPs).

Recently, it has been demonstrated by Fraser et al (Fraser, G W, Brunton, A N, Lees, J E and Emberson, D L Nucl. Instr. and Meth. A 1993, 334, 579) that spherically slumped MCPs may be used as focussing and collimating X-ray optics. Spherically slumped MCPs have been shown to obey the well known "thin lens" equation:

$$\frac{1}{l_s} - \frac{1}{l_f} = \frac{1}{f} = \frac{2}{R} \tag{1}$$

where $l_s$ and $l_f$ are the source and focal distances respectively, f is the focal length of the MCP and R is the radius of curvature of the MCP (taken to be positive when the source is positioned on the concave side of the MCP). If a point source of X-rays is positioned at the MCP focus (on the concave side of the MCP at a distance R/2) then $l_s$=R/2 and $l_f$=∞. In other words, X-rays passing through the MCP should, ideally, emerge from the MCP, after grazing incidence reflection, as a collimated beam travelling parallel to the optical axis defined by the line joining the point source and the centre of the MCP.

In Fraser et al a spherically slumped MCP with constant cross-sectional thickness was employed. In FIG. 1, a MCP 10 of this type, with cross-sectional thickness L, is illustrated. In the coordinate system used the x axis is defined as the optical axis. It was noted in Fraser et al that whilst a substantially parallel beam of X-rays 12 could be generated from a point source 14 at a distance R/2 from the MCP, the intensity distribution of this beam in a plane perpendicular to the optical axis was highly non-uniform. FIG. 2*a* shows such a non-uniform two dimensional X-ray image 20 generated with radiation of wavelength 44.7 Å. FIG. 2*b* shows the X-ray intensity distribution 22 in an axial cut through image 20 with a slice width of 6 mm. The non-uniform intensity distribution is due to the presence in the beam of a mixture of those rays experiencing one grazing incidence reflection in the channels, and those rays which pass through the channels without being reflected.

The non-uniformity of the X-ray beam is unfortunate, since a parallel X-ray beam of uniform intensity (a "flat field") is highly desirable in a number of applications such as X-ray lithography. Conventionally, a parallel or quasi-parallel beam can only be produced by maximising the separation between the source and the plane of interest, with an attendant drop in the intensity of the X-ray beam.

The present invention is based upon a novel MCP configuration which greatly improves the uniformity of the parallel X-ray beam.

Particles which have equivalent de Broglie wavelengths to X-rays, such as thermal neutrons, are within the scope of the invention.

According to the present invention there is provided a tapered microchannel plate.

The MCP may be spherically slumped and may be used to collect X-rays emanating from a point source and generate a collimated beam thereof. The length of the capillary channels may vary as a function of the distance of the channels from the optical axis so as to ensure that the probability of X-rays reflecting only once from the interior of the channel is high. The capillary channels may be circular in cross-section and the length of the channels (and hence the cross-sectional thickness of the tapered MCP) may be substantially described by the equation:

$$\frac{L(y)}{D} = [\tan(\arctan(2y/R) - \arcsin(y/R))]^{-1} \tag{2}$$

where D is the diameter of the channels, R is the radius of the curvature of the MCP, y is the perpendicular distance of the channel from the optical axis and L(y) is the length of a channel at y.

The tapered MCP may be fabricated by grinding a MCP with a numerically controlled grinding machine.

A tapered microchannel plate according to the present invention will now be described with reference to the accompanying drawings, in which.

Figure 1:
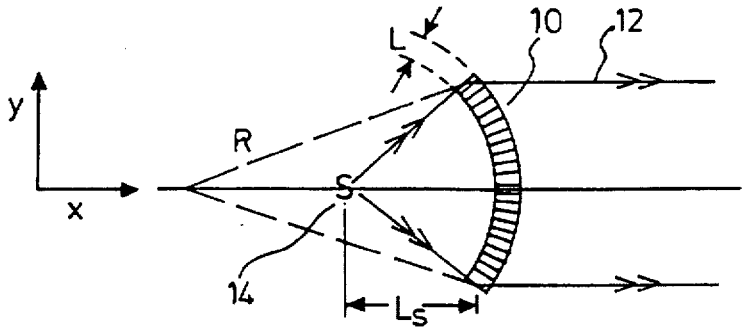
FIG. 1 is a cross-sectional view of a prior art spherically slumped MCP.
Figure 2:
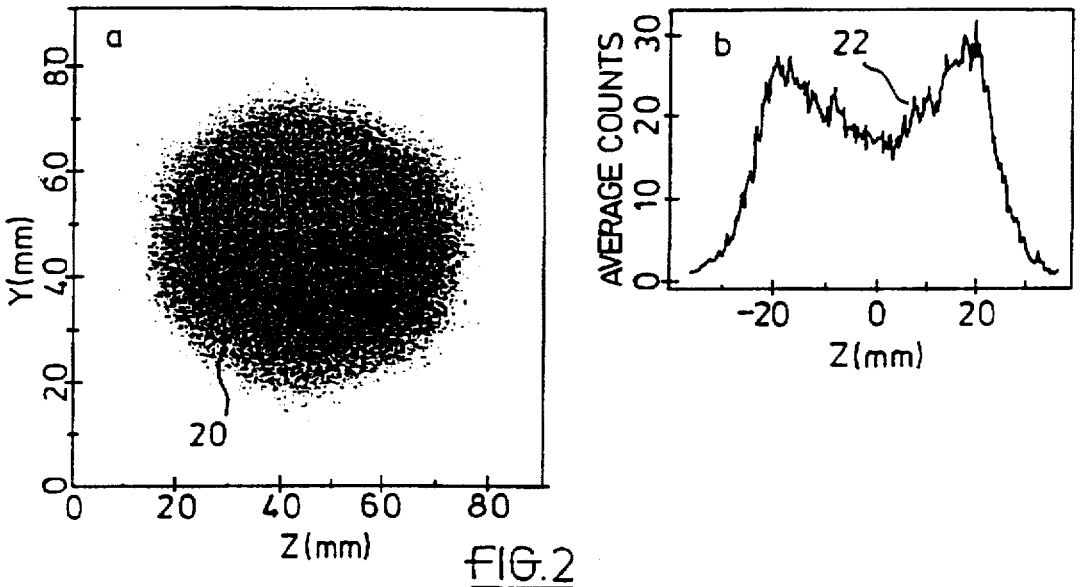
FIG. 2 shows a prior art X-ray image and an axial cut through said image.
Figure 3:
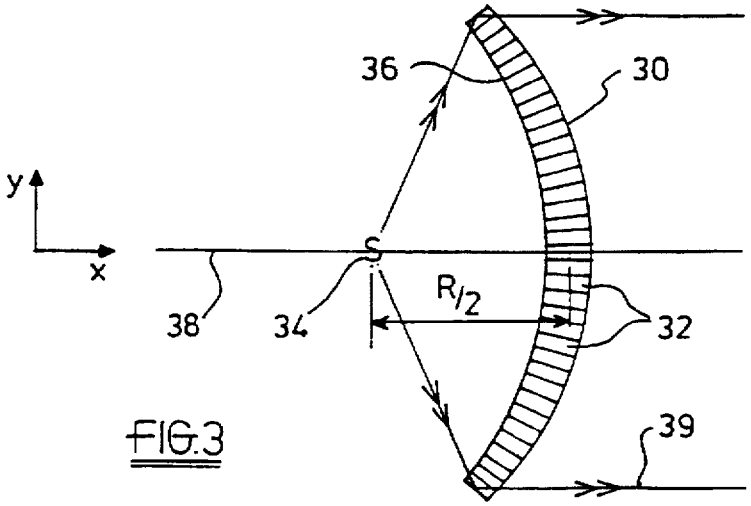
FIG. 3 is a cross-sectional view of a tapered MCP.

In FIG. 3 is shown in cross-section a tapered, spherically slumped, microchannel plate 30 comprising cylindrical channels 32 of diameter D. A source of X-rays 34, such as an electron bombardment source, is positioned a distance R/2 from the concave side 36 of the MCP on the optical axis 38. With such an optical arrangement, those X-rays 39 that emanate from the point source, enter a channel and experience one grazing incidence reflection in the channel will emerge on the convex side of the MCP as a collimated beam travelling parallel to the optical axis.

With prior art spherically slumped MCPs of constant cross-sectional thickness there is, in addition to singularly reflected rays, a small proportion of rays which undergo multiple reflection and a significant proportion which pass directly through the channels without reflection. It is this mixture of singly reflected and unreflected rays which gives rise to the highly non-uniform intensity distribution of the outputted X-ray beam generated by prior art spherically slumped MCPs.

In the present invention the length L(y) of a capillary varies as a function of the distance y of the capillary from the optical axis. Subject to certain practical constraints, which are outlined below, the variation of capillary thickness ensures that the probability is high that X-rays reflect only once from the interior of the channels.

For a spherically slumped MCP with cylindrical channels of diameter D, it is easily shown that the channel length L(y) which ensures that at a given value of y every meridional ray entering the channel is reflected once is given by equation (2), viz:

$$L(y) = D\,[\tan(\arctan(2y/R) - \arcsin(y/R))]^{-1}$$

The function L(y) corresponds to a thickness profile for an X-ray beam generating MCP. Monte Carlo ray trace computer simulations have been performed on a Silicon Graphics Challenge XL mainframe to investigate the two dimensional beam uniformity of such a device. The Monte Carlo code simulates the ray paths of unpolarised X-rays of wavelength 44.7 Å (equivalent energy 0.28 KeV, corresponding to C K radiation) emanating from a point source placed 0.7 m from the concave side of a 40 mm diameter spherically slumped MCP with a radius of curvature R of 1.4 m and a channel diameter D of 10 μm. In order to account for reflections the code calculates the smooth-surface (Fresnel) reflectivity for unpolarised 44.7 Å radiation.

Figure 4:
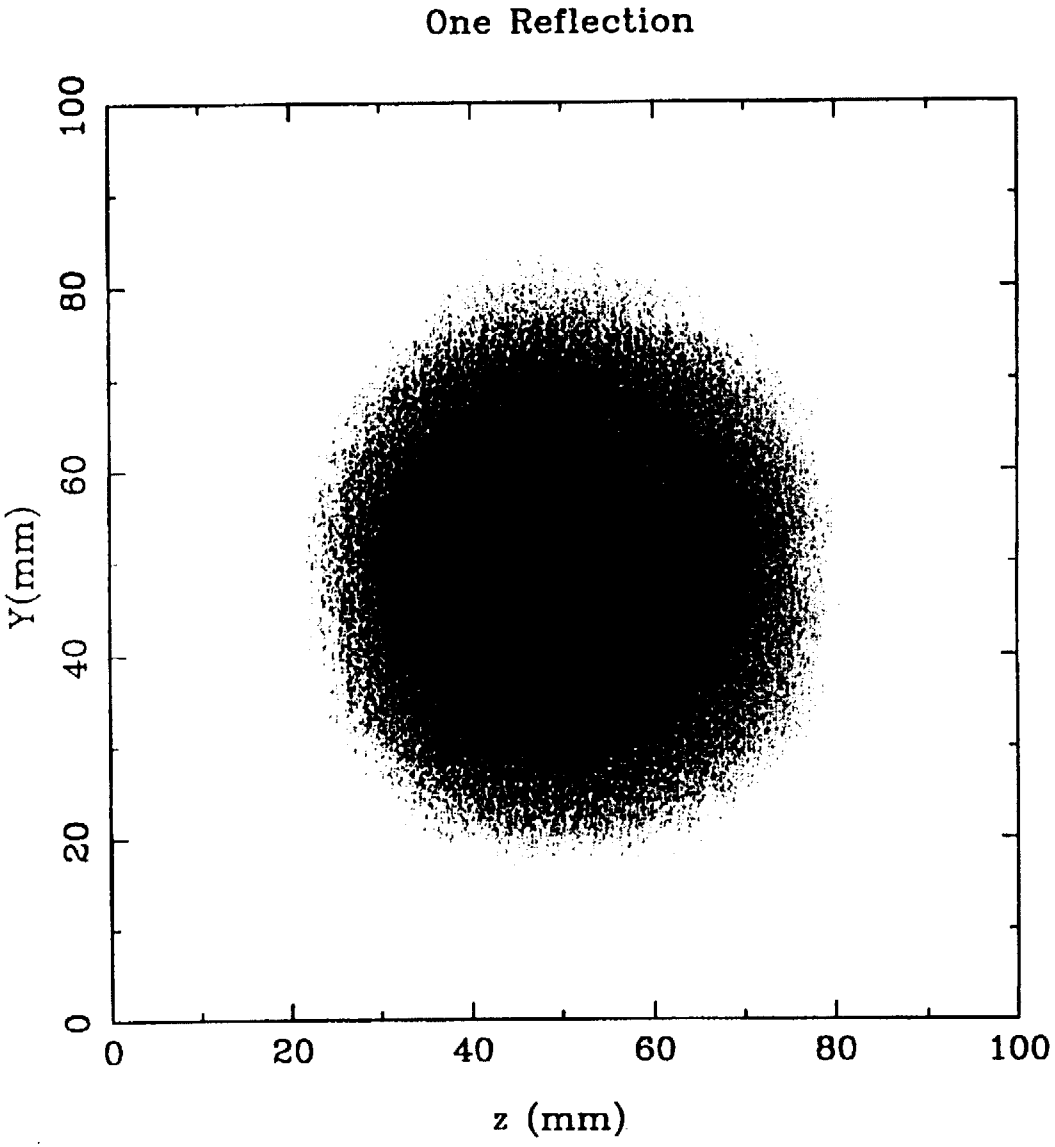
FIG. 4 is an image of singly reflected X-rays.

In FIG. 4 is shown the two dimensional X-ray image 40 calculated by the code for X-rays experiencing one reflection in the channels. The shading bar 45 indicates the relative intensity of the image. The images displayed in FIGS. 4 to 8 are all calculated for a distance 1.0 m from the convex side of the MCP and represent the beam intensity profile in the plane perpendicular to the axis of beam propagation.

Figure 5:
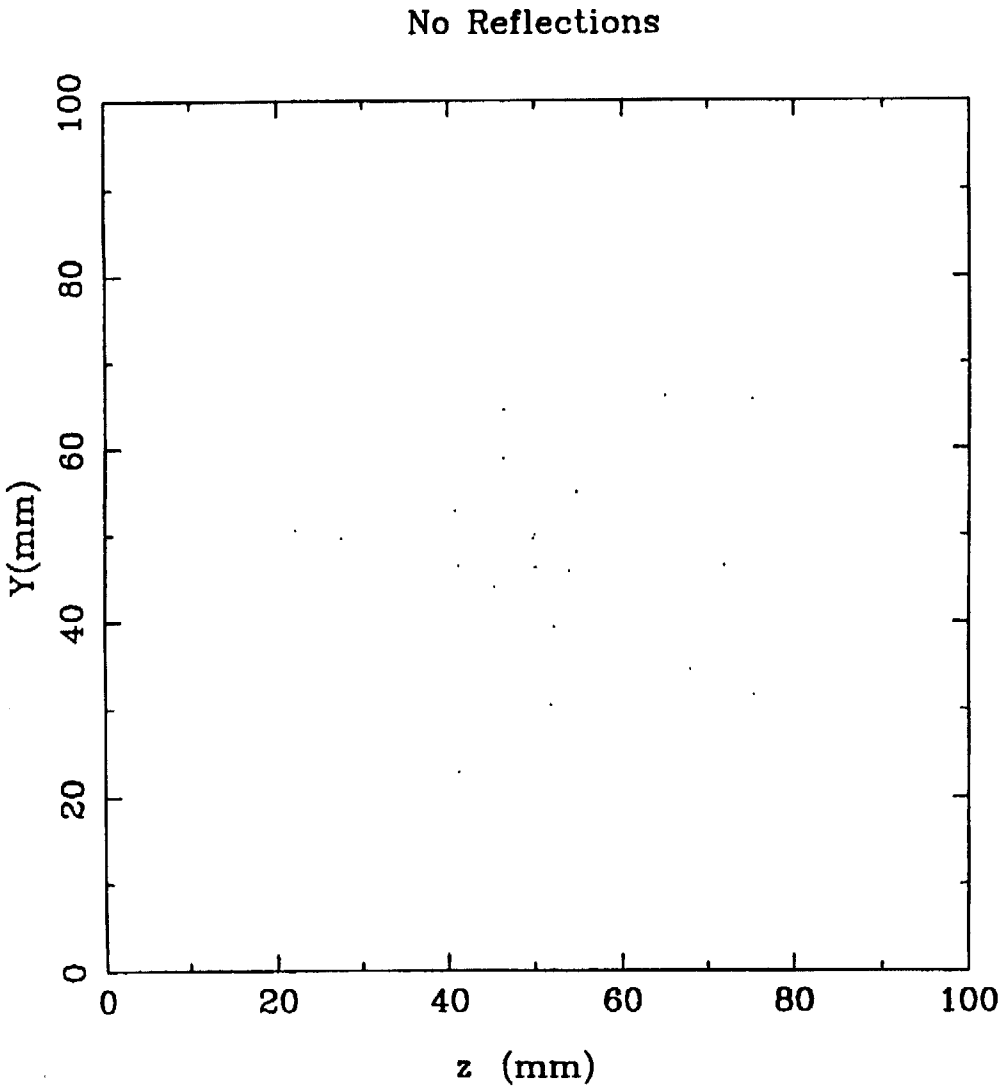
FIG. 5 is an image of unreflected X-rays.
Figure 6:
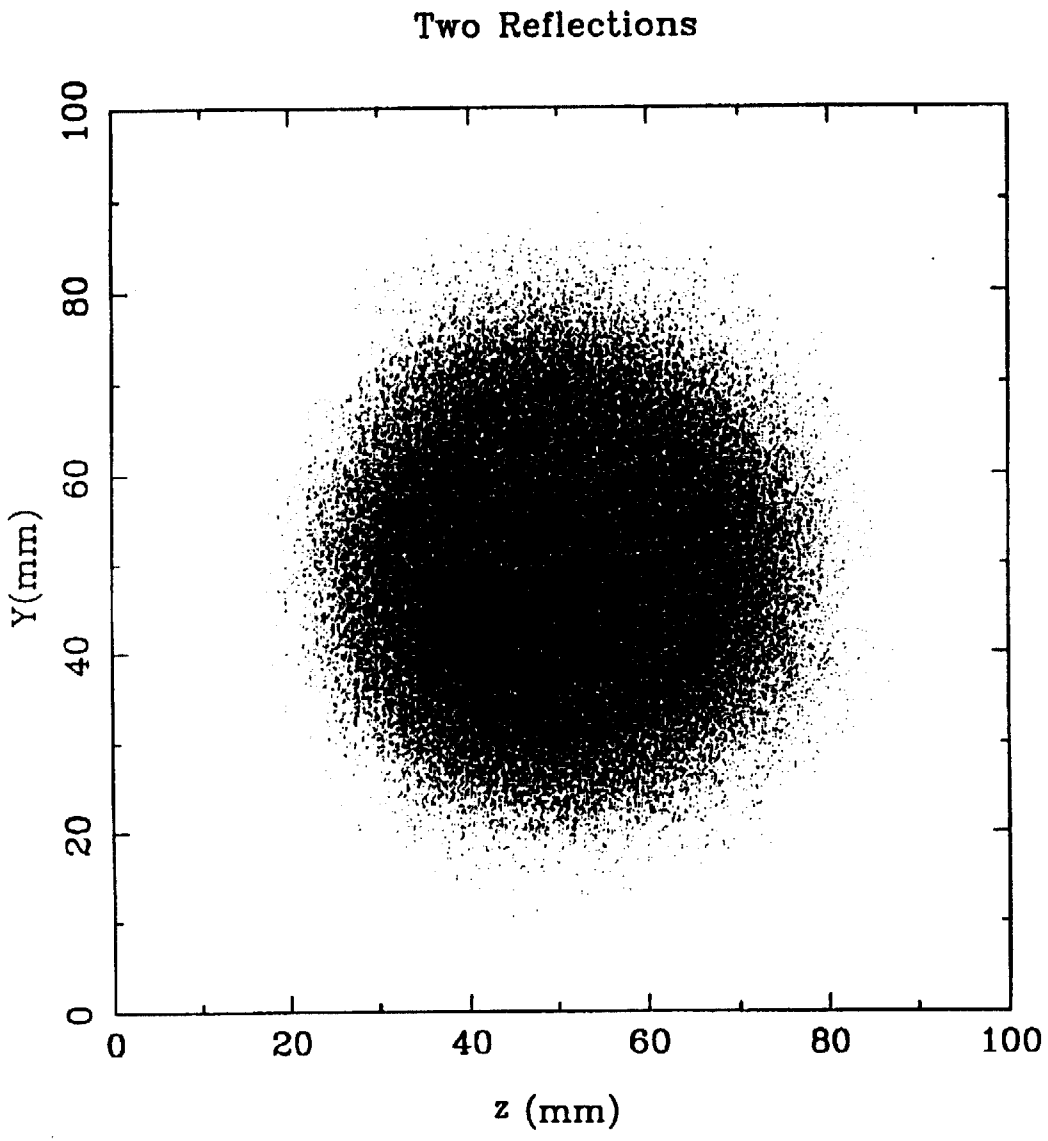
FIG. 6 is an image of doubly reflected X-rays.
Figure 7:
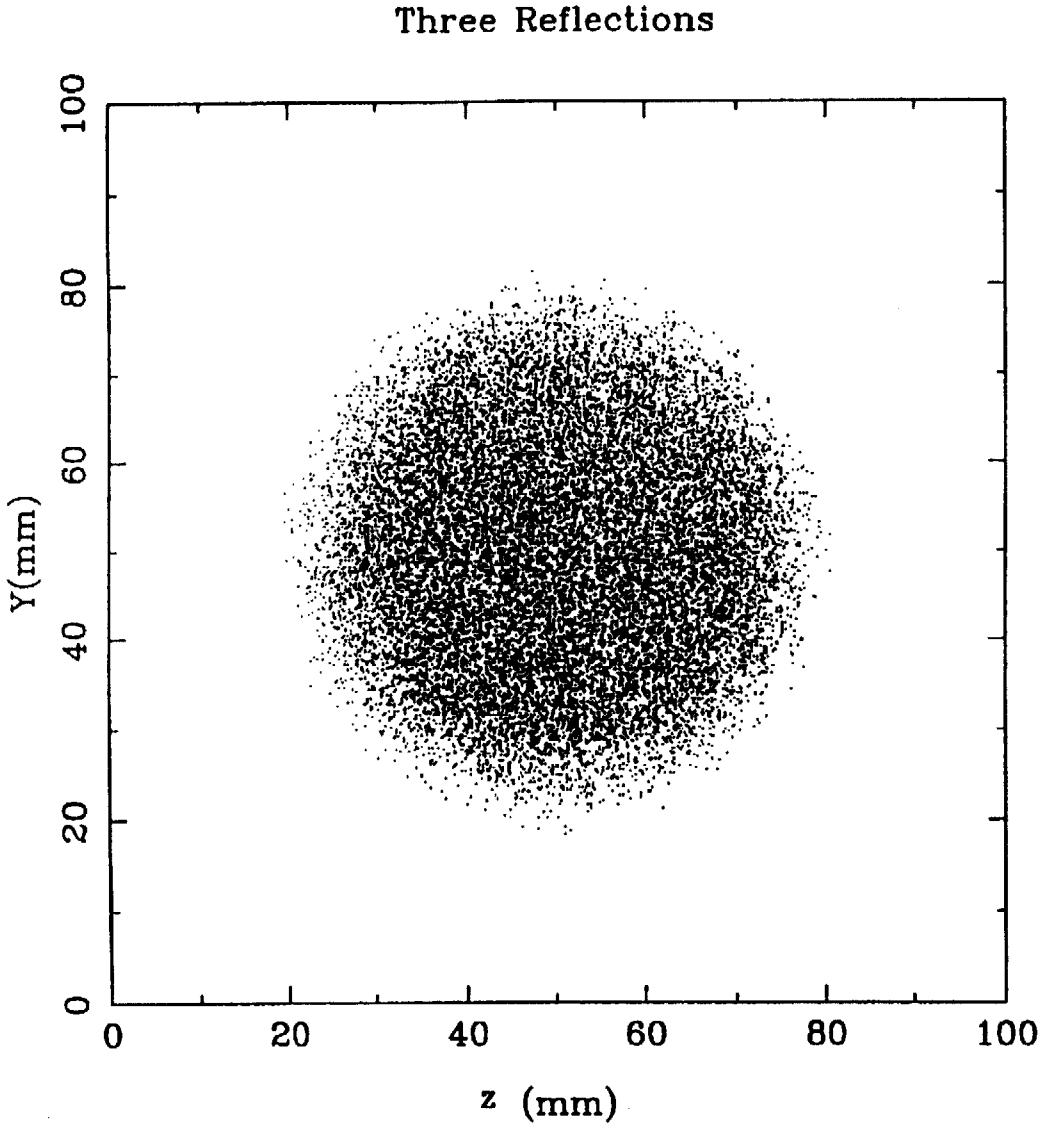
FIG. 7 is an image of triply reflected X-rays.

In FIGS. 5, 6 and 7 the images 50, 60 and 70 are shown representing X-rays undergoing no reflections, two reflections and three reflections, respectively.

FIG. 5 demonstrates that the MCP configuration all but eliminates X-rays that pass, unreflected, straight through the MCP channels.

Figure 8:
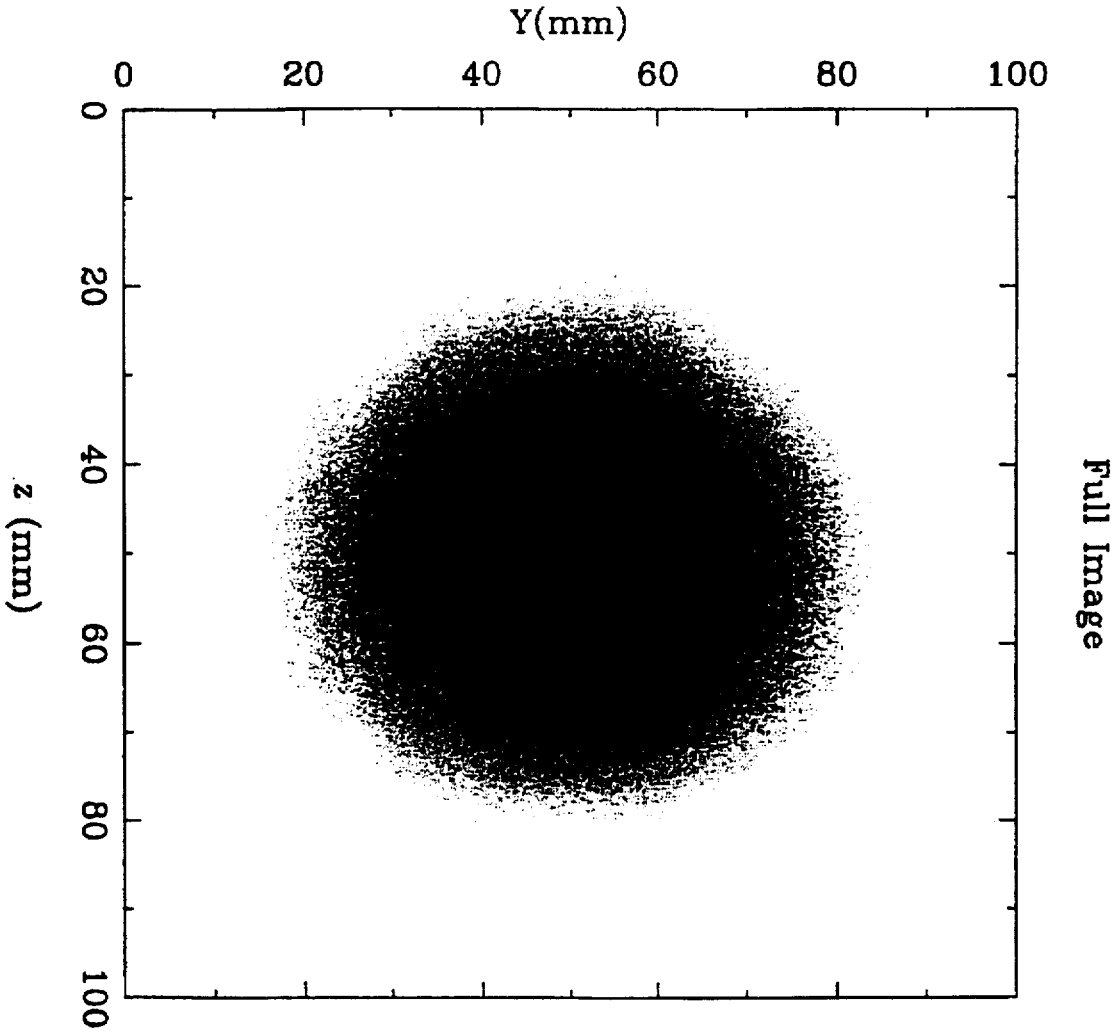
FIG. 8 is a full X-ray image.
Figure 9:
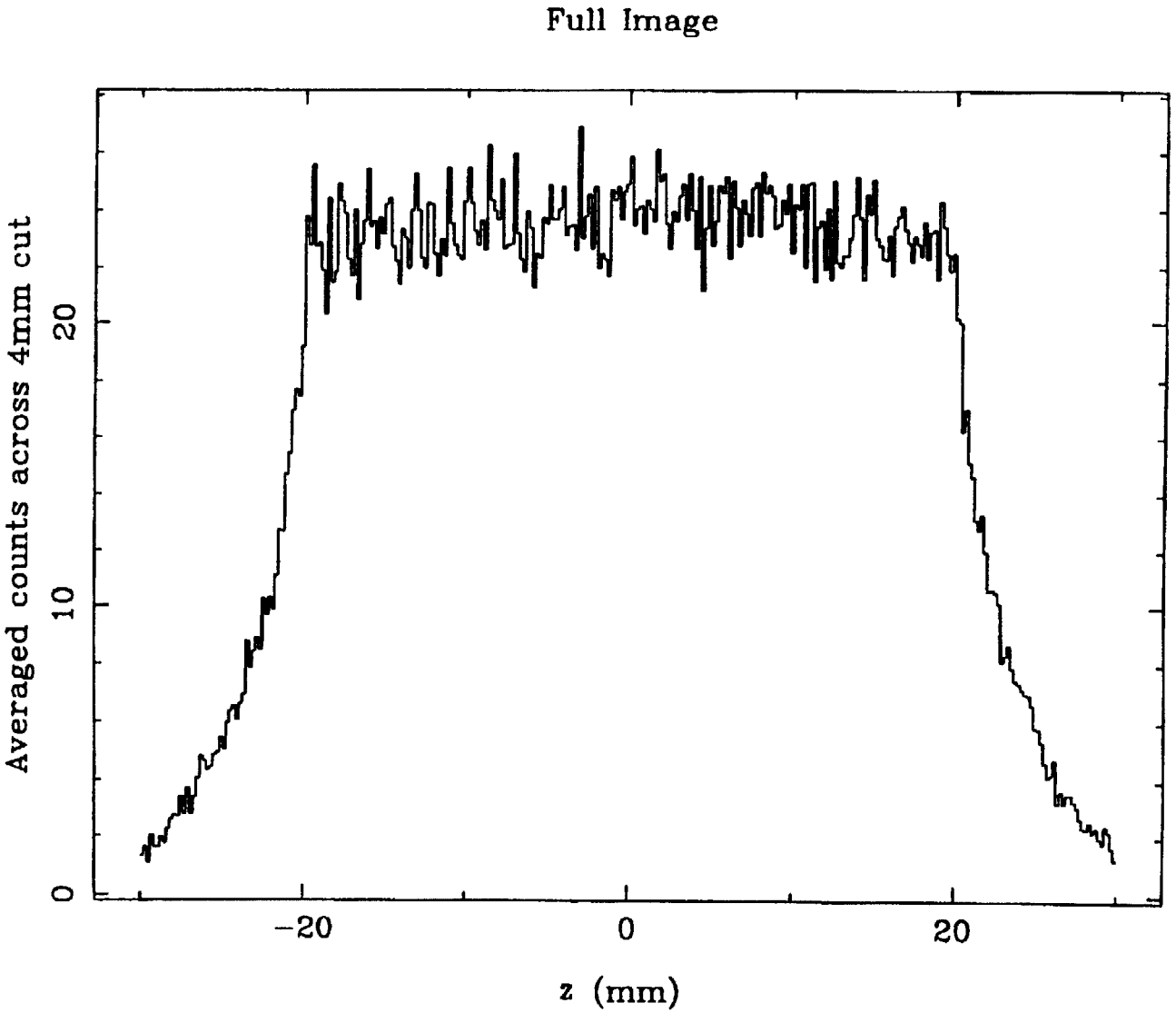
FIG. 9 is an axial cut through the full X-ray image.

In FIG. 8 is shown the full image 80, obtained by summation of the images of FIGS. 4 to 7. The full image exhibits excellent beam uniformity, the bulk of the overall beam intensity being contributed by those X-rays which have undergone single reflection. The uniformity of the beam is further demonstrated in FIG. 9 which shows an axial cut 90 through the image of FIG. 8.

Modelling of the X-ray beam at distances 0.5 and 1.5 m from the MCP indicates that the beam is substantially parallel. The slight divergence of the beam is due to contributions from non-meriodional and doubly reflected rays.

Figure 10:
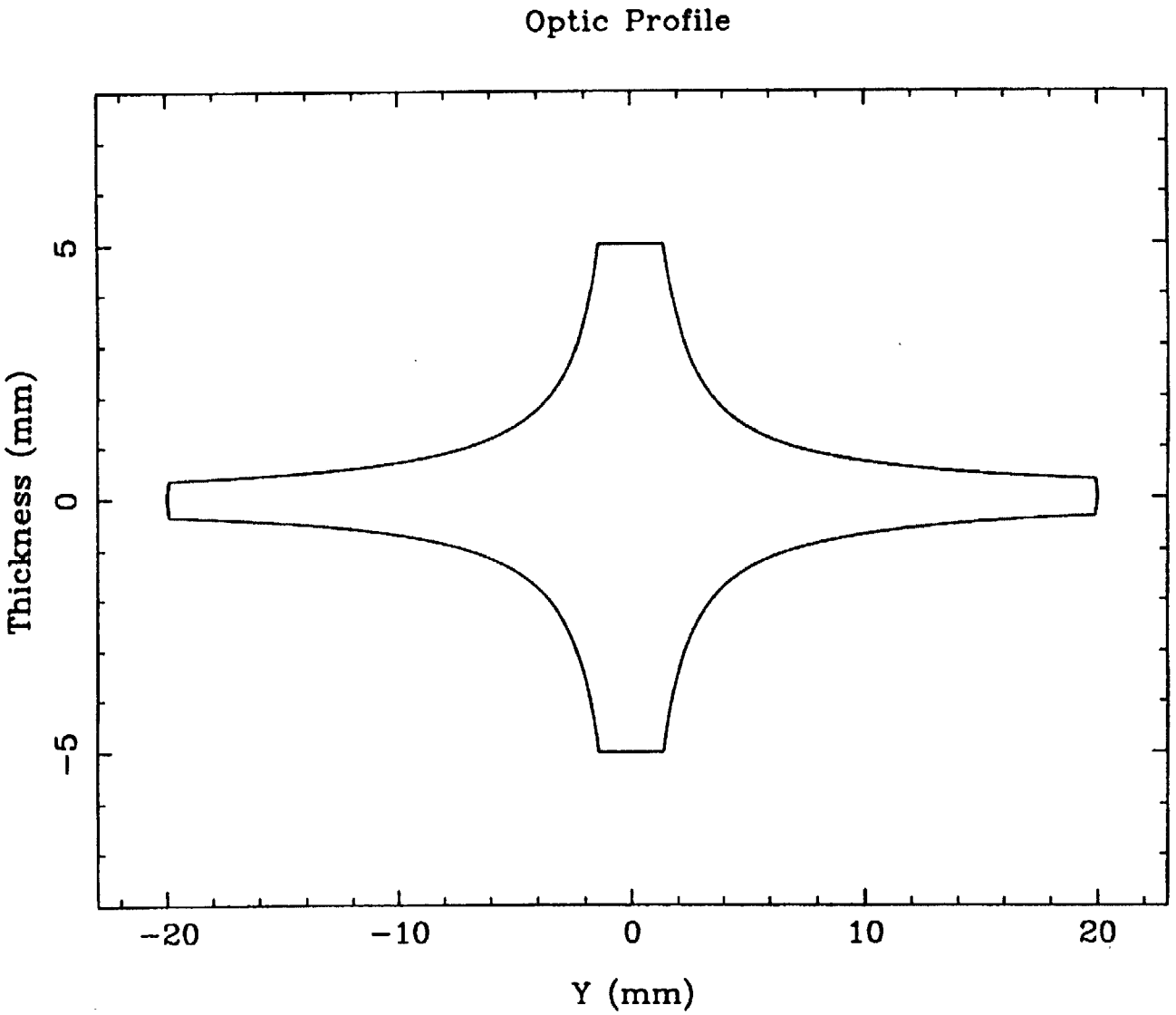
FIG. 10 is a MCP thickness profile.
Figure 11:
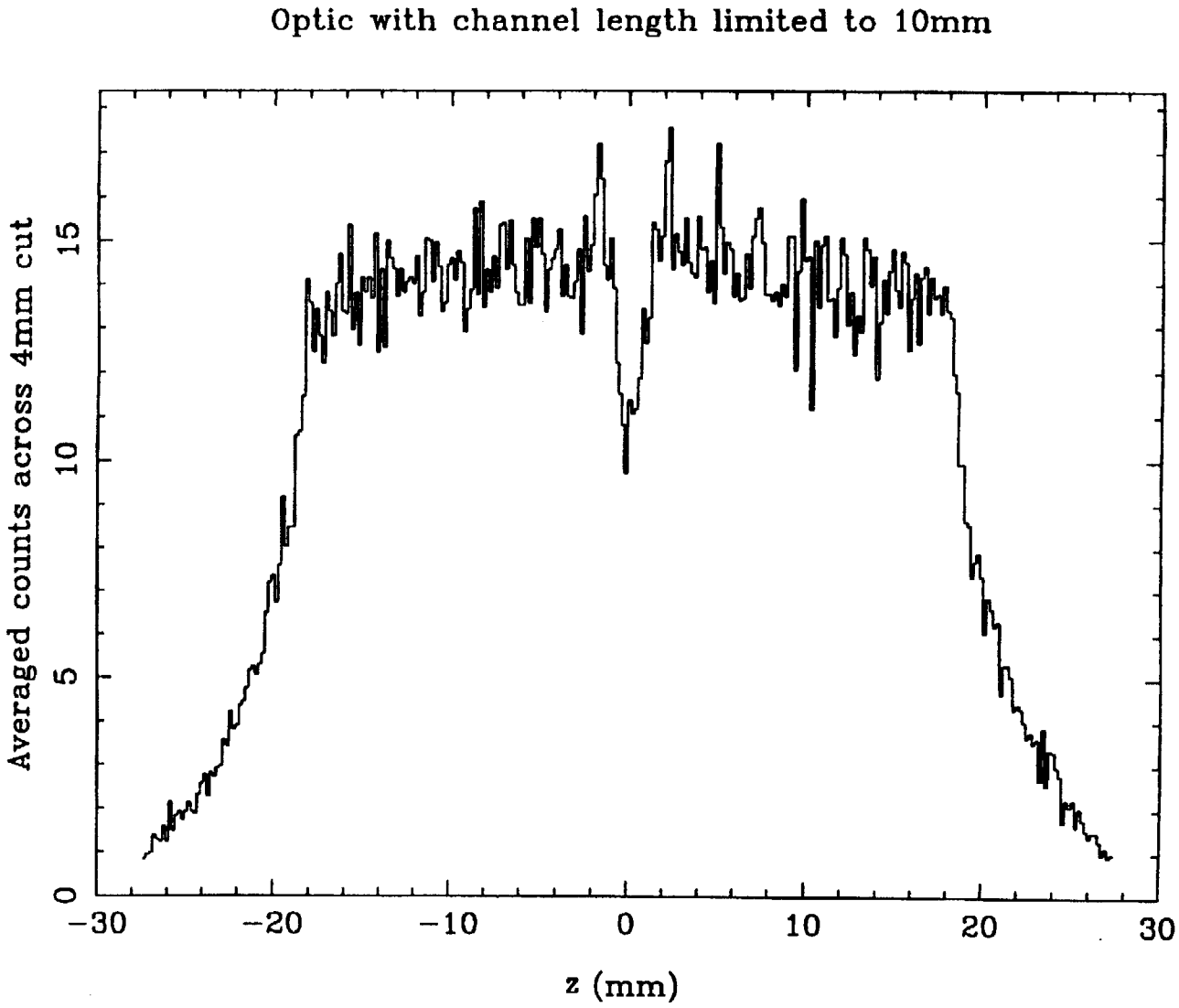
FIG. 11 is an axial cut through the X-ray image generated with a truncated MCP.

A practical MCP may possess a thickness profile based substantially on equation (2), but some truncation of the MCP thickness around the plate centre is required, since from equation (2) as $y \rightarrow O$, $L(y) \rightarrow \infty$. The truncation will produce a drop in intensity in the centre of the X-ray image, but this intensity "hole" need not be a large one. For instance, FIG. 10 shows a truncated MCP thickness profile 100 for a MCP which, apart from the truncation, is of identical design to the MCP modelled in the Monte Carlo simulation described above. A separate Monte Carlo simulation was run, incorporating the truncated MCP design of FIG. 10, again for the instance where 44.7 Å X-rays emanate from a point source placed 0.7 m from the concave side of the MCP. FIG. 11 shows an axial cut through the resulting X-ray image. The beam intensity distribution confirms that the central intensity drop is an extremely minor one. Physically, this is because, whilst the finite MCP thickness around the plate centre reduces the proportion of single reflection events, there is a partially compensating increase in the proportion of X-rays passing through channels near to the plate centre without undergoing reflection. Tradeoff studies indicate that uniformity is best for long wavelengths ($\lambda$>40 A) and large (R>1.0 M) radii of curvature (corresponding to source-optic separations >50 cm).

It should be noted that the required thickness profile need not be generated by symmetric shaping of both the inner and the outer MCP faces as depicted in FIG. 10. Rather, one face may be shaped to achieve the required thickness profile whilst the other face retains its spherical topography.

The divergence of the beam has also been examined by using the Monte Carlo code to calculate the results of a "Hartmann test" in which a mask with a regular array of pinholes is introduced between the optic and the detector. The diameter and shape of the images of the pinholes provides an indication of the so-called local divergence, whilst the position of the image centroids in relation to the centres of the holes indicates the global divergence. A local divergence of less than 5 mrad and a global divergence of less than 5–20 mrad have been specified as acceptable figures.

Figure 12:
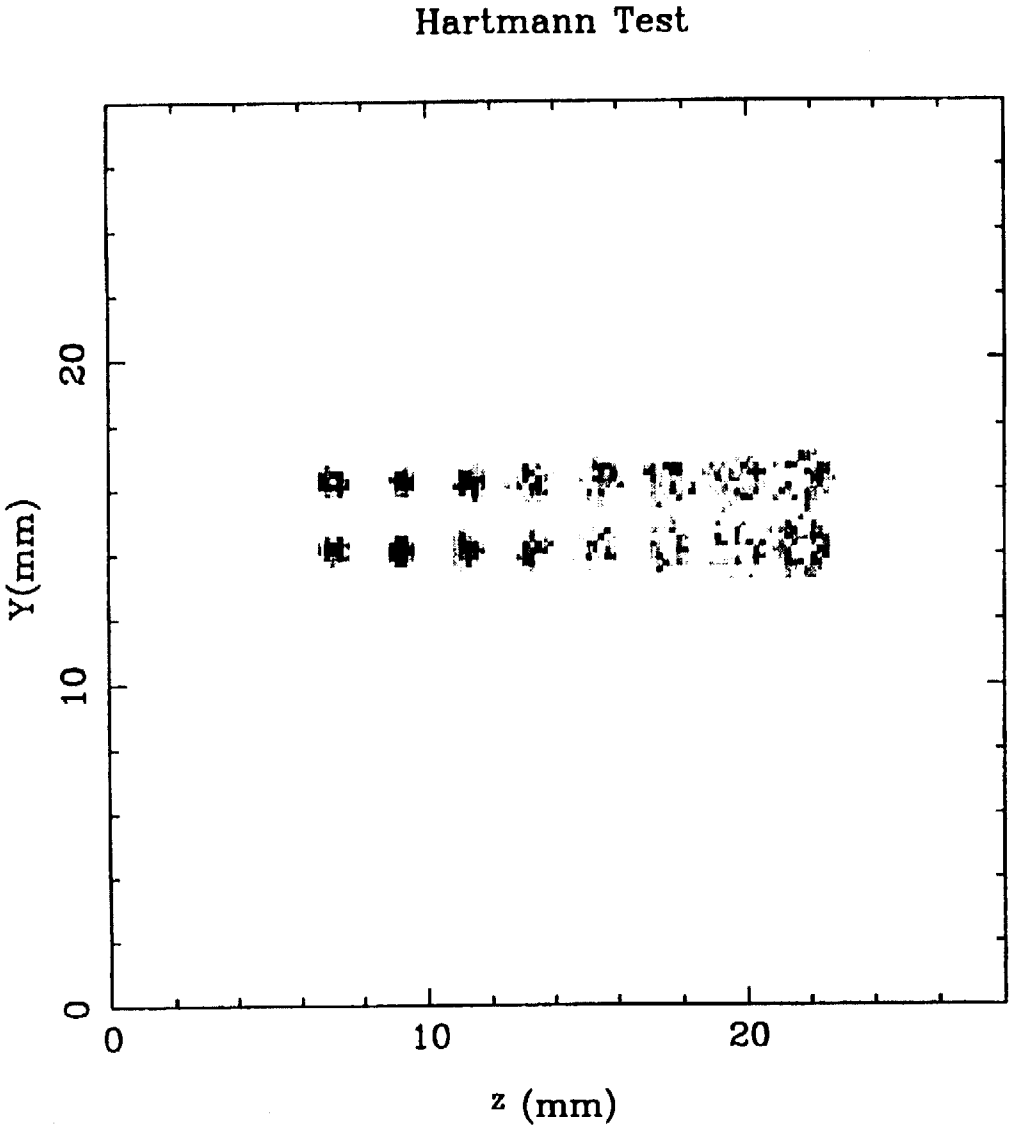
FIG. 12 shows the results of a Hartmann test.

The calculations have simulated the effect of a mask having two parallel rows of 600 μm diameter holes, one row starting on the optical axis (which contains the MCP centre) and extending (in the plane perpendicular to the optical axis) to a position parallel with an edge of the MCP with a pitch of 2 mm, and the second row being of similar description but translated 2 mm to one side of the first row. The position of the detector from the MCP is taken to be 0.5 m and the position of the mask is equidistant from the MCP and the detector (i.e. 0.25 m from each). FIG. 12 shows the simulated Hartmann image 120 for a MCP of diameter. 36 mm and radius of curvature R of 1.0 m, having cylindrical capillaries of 12.5 μm diameter (D). Unpolarised X-rays of wavelength 44.7 Å are again used in the simulation, and the thickness of the MCP is truncated by setting a maximum thickness Lmax of 10 mm. The thickness profile of the MCP is calculated using the equation $$\frac{L(y)}{D} = \frac{R}{y},$$

a relationship which is obtained by applying the small angle approximation $\sin\theta \sim \tan\theta \sim \theta$ to equation (2). For both sets of MCP dimensions described previously (in which R>>r) there is negligible difference between the thickness profile of equation (2) and the simplified profile $$\frac{L(y)}{D} = \frac{R}{y}.$$

Analysis of the results displayed in FIG. 12 indicates that the greatest local and global divergences are both ~2 mrad, confirming the estimates of parallelism described above by running simulations at variable MCP-detector separations.

A spherically slumped MCP of constant cross-sectional thickness may be ground to the desired tapered shape by a numerically controlled grinding machine.

We claim:

1. A concavo-convex spherically slumped microchannel plate, tapered so that the length of capillary channels at the edge of the plate is less than the length of capillary channels at the centre of the plate.

2. A microchannel plate according to claim 1, wherein the microchannel plate is used to collect X-rays emanating from a point source and generate a uniform collimated beam thereof, and wherein the length of the capillary channels varies as a function of the distance of said channels from the optical axis.

3. A microchannel plate according to claim 2, wherein the capillary channels are of circular cross-section.

4. A microchannel plate according to claim 3, wherein the length of said channels is substantially described by the equation:

$$\frac{L(y)}{D} = [\tan(\arctan(2y/R) - \arcsin(y/R))]^{-1}$$

where D is the diameter of the channels, R is the radius of curvature of the microchannel plate, y is the distance from the optical axis and L(y) is the length of a channel at y.

* * * * *